United States Patent [19]

Botz et al.

[11] Patent Number: 4,751,352

[45] Date of Patent: Jun. 14, 1988

[54] ELECTRIC SWITCH FOR MOTOR VEHICLES

[75] Inventors: Jokob Botz, Ingersheim; Georg Hofmann, Heilbronn-Horkhem; Hubert Spazierer; Adam Weeer, both of Bietigheim-Bissingen, all of Fed. Rep. of Germany

[73] Assignee: SWF Auto-Electric GmbH, Bietigheim-Bissingen, Fed. Rep. of Germany

[21] Appl. No.: 14,438

[22] Filed: Feb. 13, 1987

[51] Int. Cl.[4] ..... H01H 21/18

[52] U.S. Cl. ..... 200/6 BB; 200/67 DB

[58] Field of Search ..... 200/6 R, 6 A, 6 B, 6 BA, 200/6 BB, 6 C, 153 J, 153 JH, 67 DA, 67 D, 67 DB, 275, 159 A, 153 T

[56] References Cited

U.S. PATENT DOCUMENTS 1,960,020 5/1934 McGall ..... 200/67 D 2,697,364 12/1954 Koch ..... 200/153 J

*Primary Examiner*—A. D. Pellinen

*Assistant Examiner*—Morris Ginsburg

*Attorney, Agent, or Firm*—James B. Raden; Robert P. Seitter

[57] ABSTRACT

A push-button switch for motor vehicles having a snap-action switch system in which a snap spring integrally formed with a movable contact reed is clamped in a switching rocker. The switching rocker may be changed over between two end positions by way of a switching tappet of a push-button. Equal switching forces may be measured in both switching directions.

16 Claims, 6 Drawing Sheets

FIG. 14
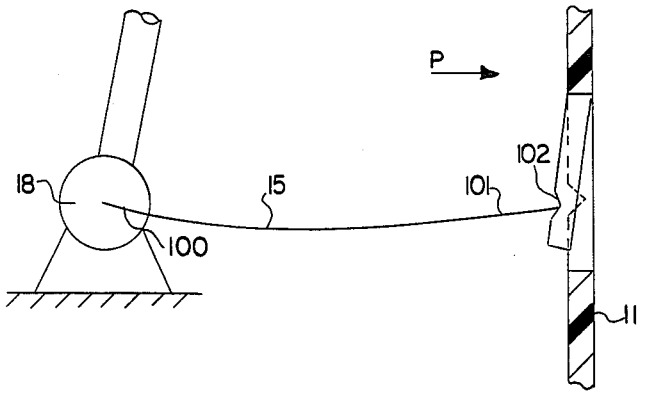
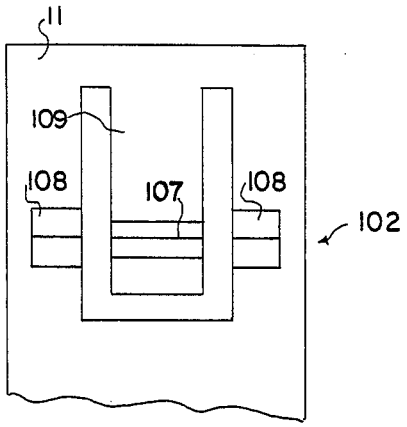
FIG. 15

ELECTRIC SWITCH FOR MOTOR VEHICLES

BACKGROUND OF THE INVENTION

This invention relates to a switch having a snap-action system and a switching rocker for use in motor vehicles.

Switches having a snap-action system have been increasingly used in modern motor vehicles, because these switches are advantageous with regard to their switching performance and service life. German specification AS No. 2,122,403 describes a switch of this kind with a snap-action system which is constructed as a toggle switch. In this known example the snap spring is supported in a stationary knife-edge bearing. At the opposite side the snap spring is clamped in a swivellable operating element, wherein the operating element is designed as an actuating element. Thus the switching motion is conducted into the snap spring at one end, whereby, due to the firm clamping of the snap spring in this operating element, the bending during the changeover of the snap spring is predetermined. During the changeover the snap spring will bend in the manner of an S, which is an advantage, because, when the changeover is initiated, the contact pressure is at first increased. This has a favorable effect on the service life and the switching performance of the switch.

However, this known switch cannot be used in all cases, because a push-button switch is often necessary instead of a toggle switch. A push-button switch with a snap-action switching system is, for example, known from the German patent No. 3,039,419. In this known example the linear motion of the operating element formed as a push-button is transmitted onto the movable contact reed by way of a star wheel having a control cam. Thus the switching force is not directly conducted into one end of the snap spring. In a push-button switch of this kind the switching forces for changing over the snap-action system differ, because the cam body acts upon the contact reed by means of lever arms with different lengths. This unbalanced changeover feeling is often objected to by the users.

Thus the object of the present invention is to create a parking position switch with a snap-action switching system as favorably priced as possible, and in which system equal switching forces in both switching directions are necessary for a changeover.

SUMMARY OF THE INVENTION

This problem is solved according to the present invention by the consideration that the snap-action switch continues to be clamped in a swivellable operating element because of the initial increase of the contact pressure during the changeover. This is possible, if the operating element is designed as a switching rocker independently of the actuating element, which switching rocker may be alternately changed over from one end position into the other by a switching tappet fixed on the actuating element. In a construction of this kind the two end positions of the switching rocker are determined by the prestress of the snap spring in the two switching positions. If the center of motion of the switching rocker is thereby located on the center plane between these two stops, a symmetrical arrangement results in such a way that the switching force to be applied by way of the switching tappet is equal in both switching directions. In a snap switch system of this kind narrow tolerances have to be adhered to in order to ensure consistent operatability. The snap spring of a preferred construction is therefore supported on the same part, preferably on a correspondingly formed stationary contact.

In a first embodiment, in which the switching rocker has two notches for the switching tappet laterally beside each other this switching tappet has a portion rigidly fixed on the operating element and a portion which may be resiliently travelled out to engage in these notches. The switching tappet can thereby integrally be made of plastics material, whereby the portions are connected with each other by an area tapered in the way of a film hinge. In a construction of this kind the tip of the switching tappet glides along the notch and the switching rocker is only moved, when the tip of the switching tappet abuts the notch. This means that at first only the force of the pressure spring resetting the operating element is overcome and only after a particular travel the operating force increases considerably, because then the snap spring is additionally loaded by a motion of the switching rocker. In an embodiment of this kind a relatively high operating stroke has to be expected. This is in many cases not desired. Moreover, due to the rapidly increasing operating force, some users object to the changeover feeling. In an improved embodiment this problem is solved in that the switching tappet is swivellably mounted on the operating element, wherein the switching position of the switching rocket determines the rest position of the switching tappet by way of a resilient intermediate member. The switching tappet of an embodiment of this kind is always accurately aligned in the end area of the notch, so that a gliding alongside the notch is no longer applied. Consequently the idle stroke is smaller and the operating force increases essentially linearly.

A separate tension spring can be used as a resilient intermediate member. However, an embodiment is preferred in which a resilient web projects integrally from the switching rocker, which web acts upon the switching tappet beyond the center of motion and changes over the tappet to the respective position.

In a switch of this kind it is also important that the snap spring is changed over from one end position into the other end position free from friction. This cannot be ensured by supporting a snap spring end in a knife-edge bearing. Therefore, in a preferred embodiment the snap spring projects with at least one stud into an aperture, preferably on a stationary contact, wherein the height of this aperture permits a free movability of the snap spring stud. In the two switching positions of the snap spring, the free front face of the snap spring is indeed linearly supported on the stationary contact laterally of the stud, so that an increased friction during the changeover is avoided.

In principle the contact reed could be made independently of the snap spring as in the first-mentioned embodiment, which advantageous as far as switches with a high current load are concerned. If, however, the switch has only to connect low currents a cost effective construction provides that the contact reed is integrally formed with the snap spring.

As previously alluded to, during the changeover the snap spring bends in the manner of an S. This is why there are areas which are exposed to a relatively great strain. In the interest of a long service life of this snap spring it is therefore suggested to form the snap spring in such a way that it has a larger cross-section in these areas of higher strain than, for example, in the supporting places or the clamping place on the operating element. Furthermore, in the interest of a long and at the same time a bounce-free service life, the contact reed can be designed in such a way that it tapers from the portion changing into the snap spring to the area carrying the contact.

Snap switch systems having a leaf spring being supported on two opposite ends, which leaf spring in one rest position is bent towards one side and in the other rest position towards the other side have very low production tolerances as a prerequisite. If the leaf spring is too long the forces appearing during the changeover are too great and the spring can break before its demanded service life is terminated. If, however, the leaf spring is too short its changeover will lose velocity. In order to work with higher production tolerances and thus more favorably with regard to costs it is of advantage for an electric switch with a housing, having a leaf spring as a snap spring clamped between two bearings and an operating element, by which the leaf spring may be acted upon in both switching direction, if an arc is formed in the leaf spring, onto which the leaf spring exerts a force in its longitudinal direction. Now greater production tolerances are compensated for by a spring-motion of the arc, so that a breaking of the snap spring is reduced without substantially decreasing the velocity of the snap action. The snap action is particularly little affected if the arc is not arranged in the center of the leaf spring, but between the center and one end of the leaf spring.

Other embodiments relate to different arrangements of the arc inside the leaf spring with regard to the operating element, by which the leaf spring may be acted upon outside its center positioned between its two ends. If a large swivelling angle is to be necessary to effect a changeover of the leaf spring it is favorable to provide the arc in the vicinity of the operating element in accordance with another embodiment. If, however, a small swivelling angle is sufficient, it has been found suitable to arrange the arc between the center of the leaf spring and that end of the leaf spring which is farther away from the operating element.

It is advantageous for achieving substantially the same switching behavior in both switching directions, if the leaf spring includes an arc each rising in one direction and in the other direction. A complete symmetry is the result if, seen in the longitudinal direction of the leaf spring, in a further construction the two arcs are located in the same place.

In an electric switch with a housing, with a leaf spring as a snap spring clamped between two bearings and with an operating element, by which the leaf spring may be acted upon in both switching directions, greater production tolerances can be compensated for in that one bearing of the leaf spring is a combination of a resilient element arranged on the longitudinal direction of the leaf spring and a counterbearing arranged firmly and laterally of the bearing of the resilient element and that the snap spring abuts the firm bearing upon a particular deflection of the resilient bearing. A bearing of this kind can still be considered stationary, because at most a movement in the longitudinal direction of the leaf spring takes place.

If the arcs can only move resiliently in a limited way or one end of the resilient bearing abuts the firm bearing upon a particular deflection it is ensured that a minimum force has to be overcome during the changeover.

BRIEF DESCRIPTION OF THE DRAWING

The invention and its advantageous developments are described below in detail by way of the embodiments shown in the accompanying drawing in which:

FIG. 14 is a schematic view of a construction in which one bearing of the leaf spring is a combination of a resilient bearing and of a firm bearing; and FIG. 15 is a view of the leaf spring of FIG. 14 in the direction of arrow P on the contact sheet metal on which the bearing is formed.

DETAILED DESCRIPTION OF THE DRAWING

Figure 1:
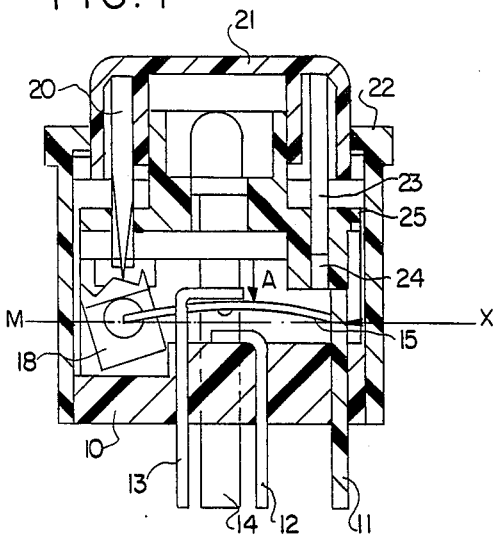
FIG. 1 is a cross-sectional view through a first embodiment of the present invention.

In FIG. 1 the base plate of the switch is designated 10, on which base plate the snap-action switching system is constructed. The switch includes several contacts 11, 12, 13 and 14 and a prestressed snap spring 15 with an integrally formed movable contact reed 16 having a contact bead 17, which alternately cooperates with stops forming an angle on the stationary contacts 12 and 13. The snap spring is one-sidedly supported on a stationary bearing, namely, the stationary contact 11, which will be described in detail hereinbelow. On its opposite side, snap spring 15 is clamped in an operating element 18 which is swivellably mounted on the base plate 10. This operating element 18 is formed as a switching rocker and on its front face it has a W-shaped contour with two notches 19, **19*a* for a switching tappet 20, which is fixed on an operating element 21 formed as a push-button. This push-button 21 is linearly displaceably guided in the housing designated 22, wherein guide webs 23 glide in corresponding guide recesses 24 of an intermediate plate 25**.

Figure 5:
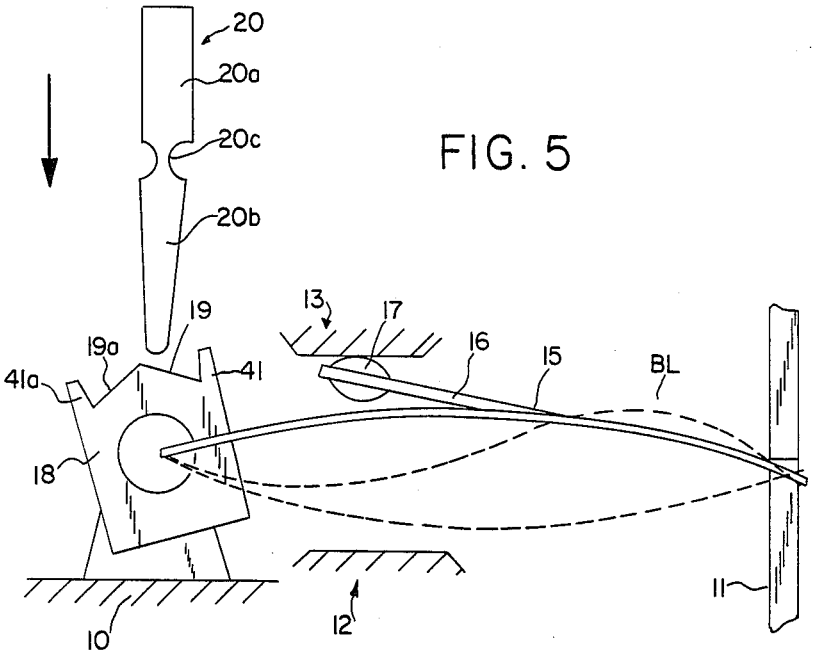
FIG. 5 is a schematic view of the snap-action system in accordance with the present invention.
Figure 6:
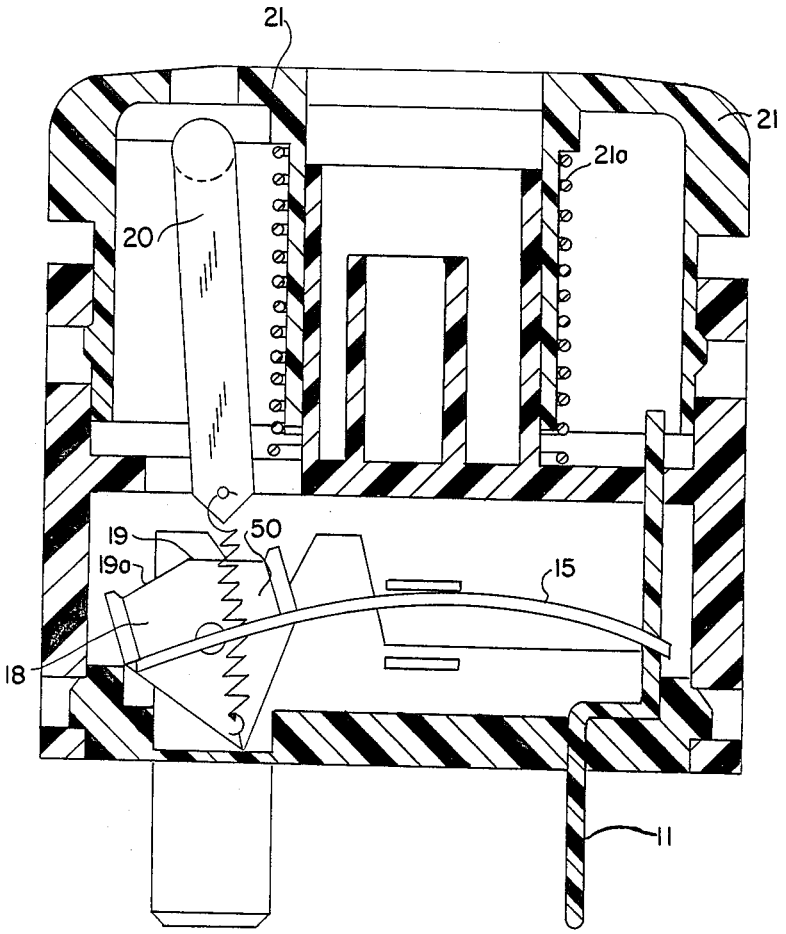
FIG. 6 is a cross-sectional view through a second embodiment of a switch in accordance with the present invention.

As can be seen by reference to FIGS. 1 and 5, the operating element 18 is formed separately from the operating element 21 as a switching rocker. This switching rocker can alternately be changed over from one end position into the other, whereby with the first operating action the switching tappet 20 engages in the notch 19 and then, after springing back of the push-button effected by a pressure spring 21*a* as shown in FIG. 6, in the direction of the other notch 19*a*, so that in the following switching action this switching tappet 20 engages in the notch 19*a* and changes over the operating element 18 in the position shown again. The end positions of this switching rocker 18 are thereby determined by travelling out of the snap spring 15. Thus exactly equal switching forces are required for changing over this snap-action switch by way of the push-button 21, if the axis of rotation of this switching rocker 18 is arranged on the center plane M between the two stops formed by the bent ends of the stationary contacts 12, 13.

Figure 2:
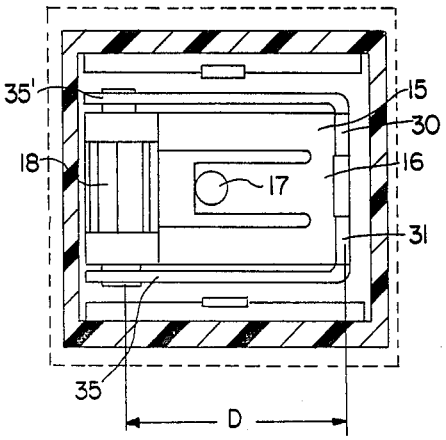
FIG. 2 is a view on the snap-action mechanism of FIG. 1 in the direction of arrow A.
Figure 3:
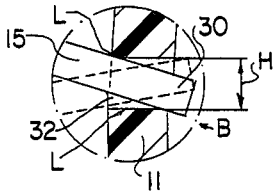
FIG. 3 shows the detail of FIG. 1 at an enlarged scale.

It can be seen by reference to FIG. 2 that the snap spring 15 has two studs 30, 31, which project into corresponding apertures 32, 33 on the stationary contact 11. The height H of these apertures 32, 33 is selected in such a way that the free movability of the studs 30, 31 in these apertures 32, 33 is ensured. Thus the snap spring 15 is not bent in the transition area of these studs 30, 31, which would be bent, if the height H of these apertures 32, 33 corresponded to approximately the thickness of the snap spring 15. Due to this particular construction of the support of the snap spring 15 on the stationary bearing a frictionless movability of the snap spring 15 is achieved, which snap spring in the area between the studs 30, 31 rests only linearly against the said stationary contact 11 as has been indicated at L in FIG. 3.

Figure 4:
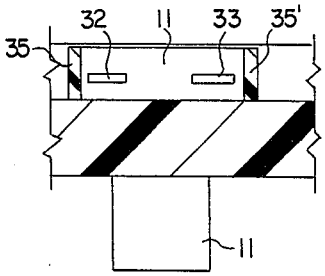
FIG. 4 is a view in the direction of arrow B of FIG. 3.

It can in particular be seen by reference to FIGS. 2 and 4 that the contact web 11 has two arms 35, 35' formed in the manner of an angle and arranged in parallel to each other, which arms are arranged on opposite sides of the snap spring. These arms 35, 35' have bearing seats for the switching rocker 18. Thus in this manner an exact spacing is ensured between the two supporting points of the snap spring 15, which fact is very important for consistent switching behavior. The snap spring 15 is fixed in the switching rocker 18 in exact position, because this snap spring 15 is preferably inserted in an injection-molding tool and then injection molded onto the switching rocker 18.

The principle of this snap-action switch is shown in FIG. 5 in an enlarged scale. One can see that the snap spring 15 lies prestressed between their supporting points and is therefor slightly curved. The contact bead 17 on the contact reed 16 rests against the stationary contact 13 in one switching position. If the switching rocker 18 is now swivelled in clockwise direction by the switching tappet 20 the snap spring is bent in accordance with the bending line BL. The snap spring 15 occupies a substantially S-shaped position. In this connection it is important that, upon initiating the changeover, the end area of the snap spring supported on the stationary contact 11 has a greater curvature as has been indicated in broken lines. Because the contact reed 16 is formed onto the end area of the snap spring upon initiating the changeover the contact bead 17 is at first pressed against the associated stationary contact 13 with a greater force. Thus during the changeover the contact pressure is at first increased, which is very important for the desired switching behavior.

In FIG. 5 a further important detail can also be seen. The switching tappet 20 has two portions 20*a* and 20*b* separated from each other in the manner of a film hinge by a tapered area 20*c*. The portion 20*a* is rigidly fixed in the push-button 20, whereas the portion 20*b* may be resiliently travelled out, so that it can glide along the notches 19 or 19*a* until it rests against the stops 41, 41*a*. Thus it can be seen from the representation in FIG. 5 that upon actuation of the push-button and thus of the switching tappet 20 at first an idle stroke without considerable switching force is run through. Then the tip of the switching tappet 20 abuts the notch 19. Upon a continued operation of the switching tappet the tip of the switching tappet 20 runs along the front face of this notch, and, consequently, the portion 20*b* is travelled out. For this purpose a slightly higher switching force is necessary. Only when the tip of the switching tappet 20 rests against the stop 41 in the end area of the notch the switching rocker is changed over and then a high switching force must be applied. Thus, it should now be appreciated that in this construction a constantly increasing operating force cannot be achieved, but rather there are jumps present to which some users object.

This disadvantage is avoided to a great extent in the construction according to FIG. 6. In this construction the switching tappet 20 is indeed swivellably mounted on the push-button 21. A resilient intermediate member in the shape of a tension spring is on the one hand suspended on this switching tappet 20 and on the other hand on the switching rocker 18. It can be seen from FIG. 6 that the position of the switching rocker 18 determines the rest position of the switching tappet by way of this resilient intermediate member 50, which switching tappet is consequently aligned in such a way that it is directly aligned into the end area of the notch 19. If the push-button 21 of this example is actuated, it is first also necessary to overcome the idle stroke by a low operating force, however, in this case the tip of the switching tappet does not glide along the switching slope of the notch 19, but is rather directly conducted into the end area of the latter. Thus, when the idle stroke is overcome, the operating force increases rapidly without a noticeable jump. Thus this measure considerably improves the changeover feeling.

Figure 8:
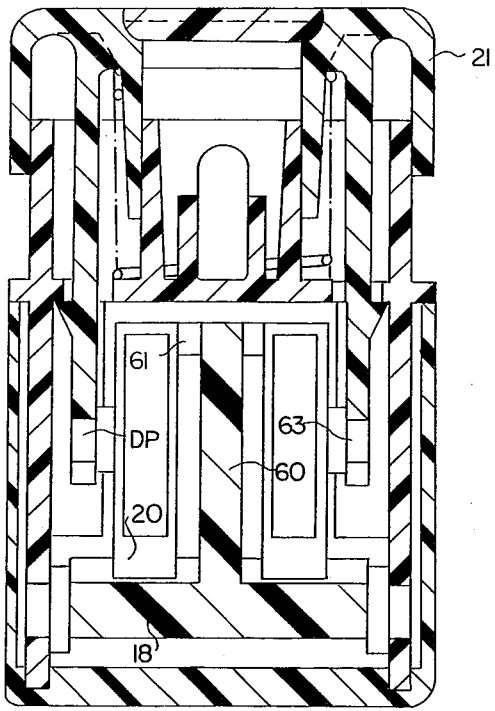
FIG. 8 is a cross-sectional view taken along the line VIII—VIII of FIG. 7.
Figure 7:
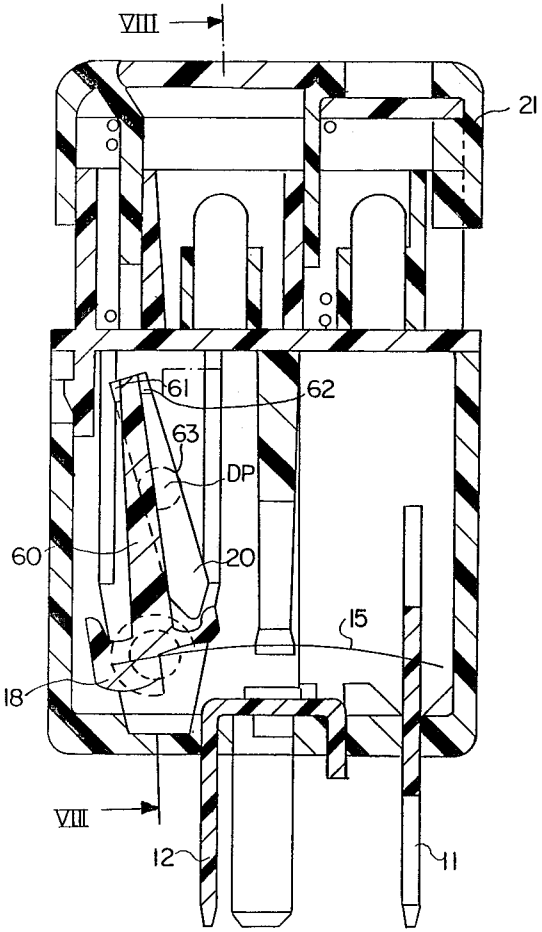
FIG. 7 is a cross-sectional view through a third embodiment.

In the embodiment according to FIG. 6 the resilient intermediate member is formed as an additional part in the shape of a tension spring. In FIGS. 7 and 8 a switch is shown in which a resilient web 60 integrally formed onto the switching rocker 18 serves as a resilient intermediate member, which resilient web acts upon the switching tappet 20 beyond the center of motion DP. For this purpose the upper end of the web 60 (as shown in FIG. 7) projects between two driver lugs 61, 62 located at the upper end of the switching tappet 20. Thus, the position of the upper portion of web 60 determines the rest position of the switching tappet 20 in dependence on the switching position of the switching rocker 18. From FIG. 8 it can be seen that the switching tappet 20 is swivellably mounted in a locking recess of the push-button 21, which locking recess is formed in the manner of a key hole.

Figure 9:
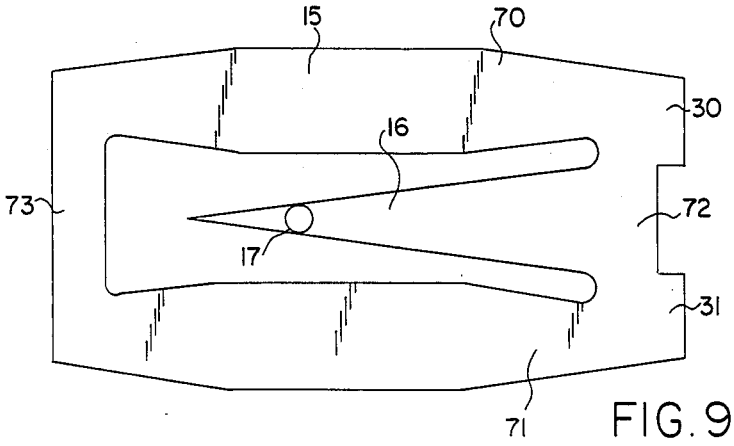
FIG. 9 is a plan view on the snap spring.

Moreover, the construction of the snap-action switch system of the embodiments according to FIGS. 6, 7 and 8 thus corresponds substantially to the principle of the embodiment according to FIG. 5, so that no further explanations in this respect are necessary. As in particular FIG. 5 clearly shows the snap spring is heavily loaded in all of these cases, wherein particular areas are exposed to higher strain. Thus the shape of the snap spring is preferably selected so that it endures differing strain even after a plurality of switching actions without thereby inadmissibly increasing the material mass of the snap spring 15. It can be seen from FIG. 9 that the snap spring 15 is integrally punched out from a blank with the contact reed 16 in such a way that two longer shanks 70, 71 are connected with each other by their ends by way of webs 72, 73. The web 72 rests against the stationary bearing, thus against the stationary contact 11, whereas the opposite web 73 is clamped into the switching rocker 18. The contact reed 16 begins at the web 72 closely to the stationary bearing and extends in parallel to the longer shanks 70, 71. It is now essential that the longer shanks 70, 71 have a larger width in their center areas than in the transition area to the connecting webs 72 and 73, because in this center area greater strain appears when they are bent in the manner of an S. The contact reed 16 has a substantially triangular contour with the basis on the connecting web 72 and the tip in the area of the contact bead 17. The material mass of the said contact reed is thus selected so small with a satisfactory loading capacity that a bouncing of the switch has not to be feared.

Figure 10:
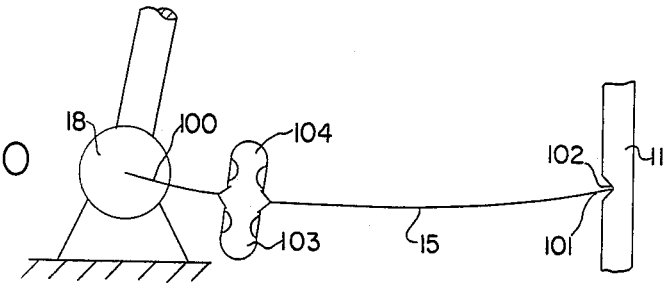
FIG. 10 is a schematic view similar to FIG. 5, however illustrating a snap spring having two arcs in the vicinity of the switching rocker.
Figure 11:
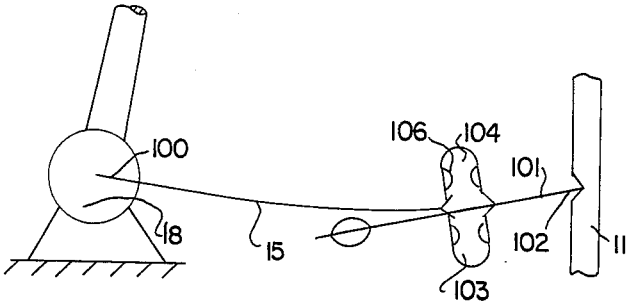
FIG. 11 is a schematic view similar to FIG. 10, illustrating, however, the arcs in a different place of the leaf spring.

In the two constructions according to FIGS. 10 and 11 one end of the leaf spring 15 is again clamped into a switching rocker 18. The latter is swivellably supported in a switch housing and can be changed over by means of a tappet as has been described above. The other end 101 of the leaf spring 15 is supported in a notch 102 of the stationary contact 11. Thus it is also swivellably supported.

In a particular portion between the two ends 100 and 101 the leaf spring 15 is adapted to form two arcs 103 and 104 extending in the plane of the leaf spring 15 in opposite directions. Seen in the longitudinal direction of the leaf spring 15 the two arcs 103 and 104 are located in the same place, but they are arranged beside each other as can clearly be seen from FIGS. 12 and 13. In order to form one arc towards one side and the other arc towards the other side the leaf spring is in a particular portion divided by a central slot 105 extending in its longitudinal direction. Because of this slot 105 the arc 103 can now stand upwardly towards one side and the arc 104 towards the other side. Due to the fact that, seen in the longitudinal direction of the leaf spring 15, the two arcs 103 and 104 are located at the same level a complete symmetry is achieved with regard to the switching behavior into one or the other direction requiring equal switching forces for a changeover in one or the other direction.

In each flank of the arcs 103 and 104 there is arranged a bead 106 pointing into the interior of the respective arc and which is positioned opposite the bead of the other flank of the same arc. In this manner the path by which the arcs can resiliently move in the longitudinal direction of the leaf spring 15 is limited.

Figure 12:
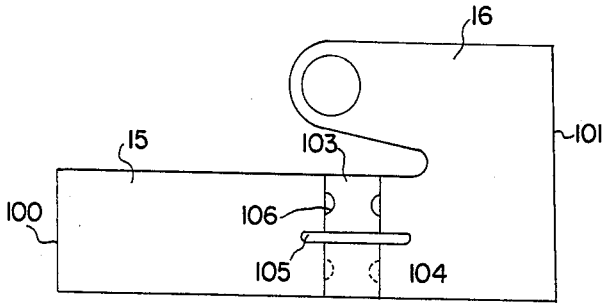
FIG. 12 is a top view on a leaf spring which can be used in the construction according to FIG. 11.
Figure 13:
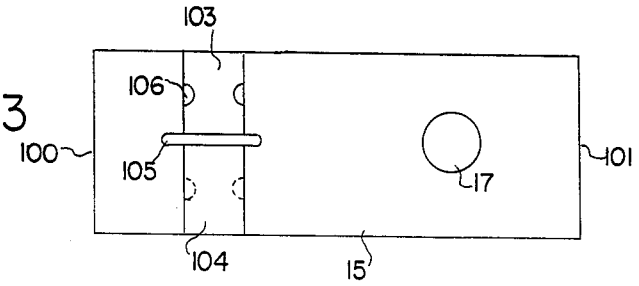
FIG. 13 is a top view on a leaf spring as it can be used in the construction according to FIG. 10.

As can clearly be seen from FIG. 12 a contact reed 16 is formed laterally onto the leaf spring 15 in a construction according to FIG. 11. This contact reed extends from the area of the connection with the leaf spring closely to the end 101 of the latter in the direction towards the switching rocker 18. In a construction according to FIG. 10, a leaf spring 15 with a contact reed 16 according to FIG. 12 can in principle also be used. The contact bead 17 can, however, as can be seen from FIG. 13, also be directly positioned on the leaf spring.

In the construction according to FIG. 10 the two arcs 103 and 104 are positioned between the operating element 18 and the center of the leaf spring 15. In the construction according to FIG. 11, however, the two arcs 103 and 104 are positioned between the end 101 and the center of the leaf spring. The lateral arrangement of the arcs 103 and 104 has the consequence that in the rest positions the lowest and the uppermost point of the leaf spring are not exactly in its center, but set off laterally towards the arcs 103 and 104. The different arrangements of the arcs 103 and 104 in the constructions according to FIGS. 10 and 11 with the same stops for the leaf spring 15 result in different switching angles of the switching rocker 18. The switching angle in the construction according to FIG. 10 is indeed larger than in the construction according to FIG. 11. If a push-button switch with a particularly short stroke is desired a construction according to FIG. 11 is of particular advantage.

In the embodiment according to FIGS. 14 and 15 again a leaf spring 15 is clamped into a switching rocker 18 by its one end 100, whereas its other end 101 is supported in a notch 102 of a contact sheet metal 11. The notch 102 is composed of a center portion 107 and two lateral portions 108. The center portion 107 is located on a resilient lug 109 cut from the contact sheet metal 11, which lug projects beyond the contact sheet metal 11 towards the switching rocker 18. Seen in the longitudinal direction of the leaf spring 15 the two lateral portions 108 of the notch 102 are worked into stationary areas of the contact sheet metal 11.

The bearing 102 for the end 101 of the leaf spring 15 is such a combination of a bearing being resilient in the longitudinal direction of the spring 15 and a bearing being firm in the longitudinal direction of the spring. Thereby the spring 15 normally is only positioned in the portion 107 of the notch 102. By a different spring movement of the lug 109 larger production tolerances of the length of the leaf spring can be compensated for. The spacing between the portions 108 of the notch and the center of motion of the switching rocker 18 is smaller than the length of the leaf spring 15, so that in case the spring lug 109 is too soft because of any reason the end of the leaf spring 15 abuts the stationary portions of the notch 102 and thus a minimum changeover force is ensured.

As can be seen by reference to FIGS. 14 and 15, the portions 107 of the notch 102 can have a smaller depth than the portions 108. Thus the lug 109 can give way as far as beyond the center plane of the contact sheet metal 11. The lug 109 can also give way as far as beyond the plane of the contact sheet metal 11 because of a portion 107 of the notch 102 projecting over the width at the end 101 of the leaf spring 15.

Thus a switch has been provided in accordance with the present invention which is characterized by a particularly simple construction with only a few piece parts, but nevertheless provides the requirement switching performance and life.

What is claimed is:

1. An electric switch, especially for motor vehicles, comprising a housing, a push-button (21), which may be linearly moved relative to the housing, a switching tappet (20) displaceable with the push-button (21), a switching rocker (18) swivellably mounted in the housing and alternately capable of being swivelled to and fro about an axis between two end positions, a leaf-spring (15) which may be changed over between two switching positions, said spring (15) supported on the switching rocker (18) at one end and at a second end on a bearing (11) fixed on the housing and a movable contact (16) coupled to said spring (15) which co-operates with at least one stationary contact (12, 13), wherein the switching rocker (18) defines the rest position of the switching tappet (20) via a resilient web (60) projecting from the switching rocker (18), which web seen from the axis of rotation of the switching rocker (18) acts upon the switching tappet (20) beyond the axis of rotation of the switching tappet (20).

2. An electric switch according to claim 1, wherein the spring (15) is braced in the switching rocker (18) by its other end.

3. An electric switch according to claim 1, wherein the spring (15) is one-sidedly directly supported on a stationary contact (11) and the switching rocker (18) is also swivellably mounted on this stationary contact (11).

4. An electric switch according to claim 1, wherein the swivelling axis of the switching rocker (18) is provided on the center plane between two stops (12, 13) determining the switching positions of the spring.

5. An electric switch according to claim 2, wherein the spring (15) is embedded in the switching rocker (18).

6. An electric switch according to claim 1, wherein a contact reed (16) is integrally formed with the spring (15) and is punched out from a blank, wherein the contact reed (16) is connected with the spring (15) at its far end from the switching rocker (18) and wherein said contact reed points towards the switching rocker (18).

7. An electric switch according to claim 6, wherein the spring (15) projects into an aperture (32, 33) on the stationary contact (11) by means of at least one stud (30, 31) and the height H of the said aperture (32, 33) permits a free movability of the snap spring stud (30, 31).

8. An electric switch according to claim 6, wherein the spring (15) has two longer shanks (70, 71) and two shorter webs (72, 73) connecting these shanks, one web (72) including studs (30, 31) to provide a support on the stationary contact (11) and the other web (73) being clamped in the switching rocker (18) and, beginning from the web (72) with the studs (30, 31), the contact reed (16) extends alongside the longer shanks (70, 71).

9. An electric switch according to claim 8, wherein the longer shanks (70, 71) have a larger width in their center area than in a transitional area to the webs (72, 73).

10. An electric switch according to claim 1, wherein there is provided a spring element upon which the spring (15) exerts a force in its longitudinal direction and the spring element is formed by at least one arc (103, 104) in the spring (15).

11. An electric switch according to claim 10, wherein the arc (103, 104) is positioned between the center and one end (100, 101) of the spring (15).

12. An electric switch according to claim 11, wherein the spring (15) may be acted upon by the switching rocker (18) outside its center positioned between its two ends (100, 101) and the arc (103, 104) in the spring (15) is positioned between the center and the switching rocker (18).

13. An electric switch according to claim 11, wherein the spring (15) may be acted upon by the switching rocker (18) outside its center positioned between its two ends (100, 101) and the arc (103, 104) in the spring (15) is positioned between the center and that end (101) of the spring (15) which is farther away from the switching rocker (18).

14. An electric switch according to claim 10, wherein the spring (15) has one arc extending from one side and a second arc extending from the other side.

15. An electric switch according to claim 14, wherein in its longitudinal direction the spring (15) is divided over a certain distance and, within this distance, it is adapted to form two arcs (103, 104) one of which extends in one direction and the other extends in the other direction and, seen in the longitudinal direction of the spring (15), the two arcs (103, 104) are in the same place.

16. An electric switch according to claim 1, wherein one bearing of the spring (15) is a combination of a resilient element (109) located in the longitudinal direction of the spring (15) and of a bearing arranged firmly and laterally of the resilient element (109) on a stop (108) and the spring (15) abuts the firm bearing upon a particular deflection of the resilient element (109).

* * * * *